US010578258B1

(12) United States Patent
Patton

(10) Patent No.: US 10,578,258 B1
(45) Date of Patent: Mar. 3, 2020

(54) REMOVABLE ILLUMINATION DEVICE FOR A BUTTON

(71) Applicant: Tina Patton, South Bend, IN (US)

(72) Inventor: Tina Patton, South Bend, IN (US)

( * ) Notice: Subject to any disclaimer, the term of this patent is extended or adjusted under 35 U.S.C. 154(b) by 0 days.

(21) Appl. No.: 14/991,120

(22) Filed: Jan. 8, 2016

(51) Int. Cl.
*F21L 4/00* (2006.01)
*F21V 23/04* (2006.01)

(52) U.S. Cl.
CPC ..... *F21L 4/00* (2013.01); *F21V 23/0428* (2013.01)

(58) Field of Classification Search
CPC ..... F21L 4/00; F21L 15/08; F21V 21/145
USPC ..... 362/191, 103
See application file for complete search history.

(56) References Cited

U.S. PATENT DOCUMENTS 5,239,450 A 8/1993 Wall
6,474,830 B1 11/2002 Hansen
6,773,133 B2 8/2004 Lee
7,695,154 B2 * 4/2010 Ellenburg ..... A43B 1/0036 362/103
8,192,042 B2 * 6/2012 Tseng ..... A43B 1/0036 362/103
9,028,112 B2 * 5/2015 Ellenburg ..... F21V 21/08 362/191
2015/0164183 A1 * 6/2015 Chen ..... A44B 1/04 362/103
2015/0170480 A1 * 6/2015 Chen ..... G08B 5/004 362/311.01
2017/0006976 A1 * 1/2017 D'Ercole ..... F21K 2/06

* cited by examiner

*Primary Examiner* — Ahshik Kim

(57) ABSTRACT

An illumination device for a button including a substantially cylindrical housing unit and a substantially cylindrical base unit having an interior surface threadably engageable with a top portion of the housing unit. A battery is removably disposed within the top portion of the housing unit. A depressible push cap is mounted atop the housing unit, with the push cap enclosing a push button actuator and a light bulb. A U-shaped clamp has a right end, a left end, and a pair of leg attachments. A lower edge of each of the pair of leg attachments is attached at a ninety degree angle to the clamp. An upper edge of each of the pair of leg attachments is attached to the housing unit. The clamp is slidably engageable with a button. The push cap is configured to activate the light when the push cap is depressed by a user.

3 Claims, 3 Drawing Sheets

REMOVABLE ILLUMINATION DEVICE FOR A BUTTON

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

SPECIFICATION

Background of the Invention

Various types of illumination devices are known in the prior art. However, what has been needed is a removable illumination device for a button including a substantially cylindrical housing unit and a substantially cylindrical base unit having an interior surface threadably engageable with a top portion of the housing unit. What has been further needed is a battery removably disposed within the top portion of the housing unit and a depressible push cap mounted atop the housing unit, with the push cap enclosing a push button actuator and a light bulb. Lastly, what has been needed is a U-shaped clamp having a right end, a left end, and a pair of leg attachments. A lower edge of each of the pair of leg attachments is attached at a ninety degree angle to the clamp. An upper edge of each of the pair of leg attachments is attached to the housing unit. The clamp is slidably engageable with a button, and the push cap is configured to activate the light when the push cap is depressed by a user. The removable illumination device thus provides an easy way in which a parent can keep track of a child's location in darkened conditions including, but not limited to, when the child is waiting for a school bus in the early morning hours. The depressible push cap ensures that the child can easily turn on and off the light bulb, and the clamp removably securing the housing unit to a button provides for a hands free use of the device. It is envisioned that the device can be sized to fit a myriad of buttons and, although not disclosed in the claims, belt buckles. Additionally, the light bulb can be interchanged for a variety of colors in order to better suit the needs of the user.

FIELD OF THE INVENTION

The present invention relates to illumination devices, and more particularly, to a removable illumination device for a button.

SUMMARY OF THE INVENTION

The general purpose of the present removable illumination device for a button, described subsequently in greater detail, is to provide an illumination device which has many novel features that result in an illumination device for a button which is not anticipated, rendered obvious, suggested, or even implied by prior art, either alone or in combination thereof.

To accomplish this, the present illumination device for a button includes a substantially cylindrical housing unit having a top surface, a bottom surface, an outer edge, and substantially cylindrical hollow top portion having a threaded exterior surface. A diameter of the top portion of the housing unit is less than a diameter of the top surface of the housing unit. A substantially cylindrical base unit has an interior surface threadably engageable with the exterior surface of the top portion of the housing unit. A diameter of the base unit substantially conforms to the diameter of the top surface of the housing unit. The housing unit and the base unit are optionally metal for greater durability. A battery is removably disposed within the top portion of the housing unit. A depressible push cap is mounted atop the housing unit. The push cap encloses a push button actuator and a light bulb. The push cap is optionally plastic. The push button actuator, the light bulb, and the battery are in operational communication with each other. The push cap is configured to activate the light when the push cap is depressed by a user.

The illumination device for a button further includes a substantially U-shaped semi-flexible clamp having a right end, a left end, and a pair of leg attachments. Each of the pair of leg attachments has a lower edge and an upper edge. The lower edge of a first of the pair of leg attachments is attached at a ninety degree angle to the clamp adjacent to the right end, and the lower edge of a second of the pair of leg attachments is attached at a ninety degree angle to the clamp adjacent to the left end. The upper edge of each of the first of the pair of leg attachments and the second of the pair of leg attachments is attached to the bottom surface of the housing unit proximal the outer edge. The clamp is disposed underneath the housing unit within an entirety of a circumference of the housing unit. The clamp is removably and slidably engageable with a button. The housing unit is disposed atop the button when the clamp is engaged with the button.

Thus has been broadly outlined the more important features of the present illlumination device for a button so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
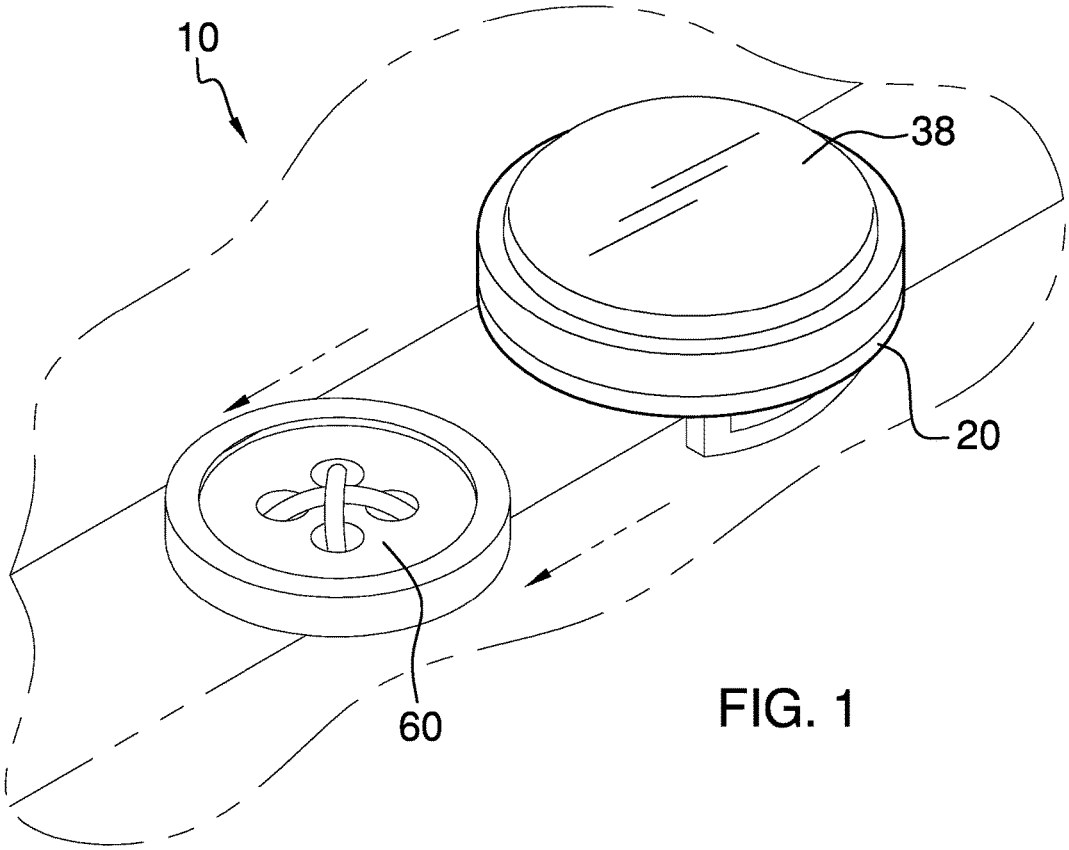
FIG. 1 is a front isometric view.
Figure 2:
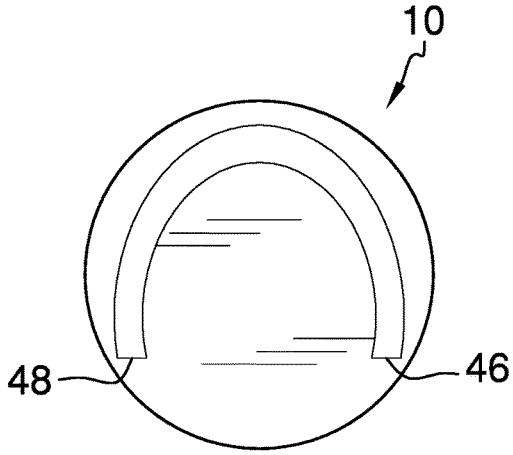
FIG. 2 is a bottom plan view.
Figure 3:
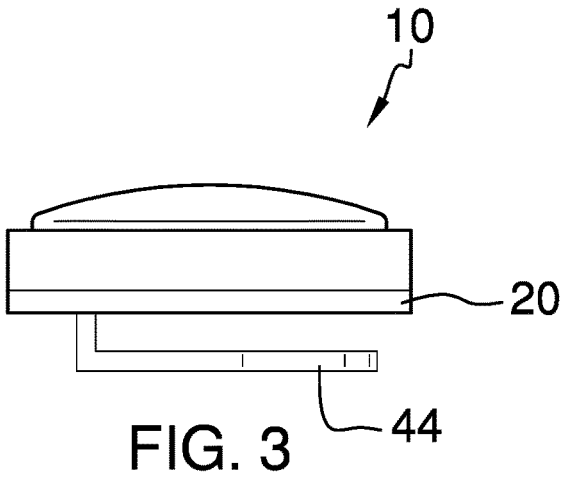
FIG. 3 is a side elevation view.
Figure 4:
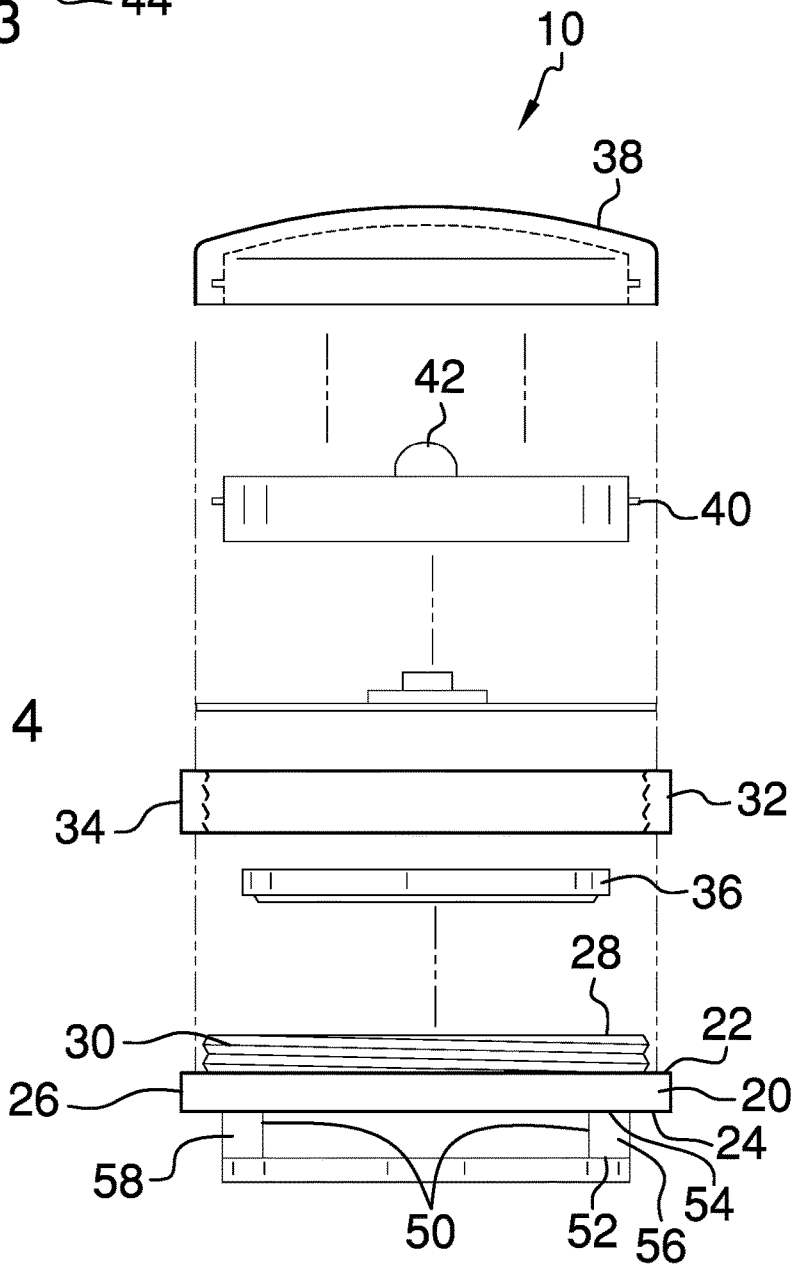
FIG. 4 is an exploded view.
Figure 5:
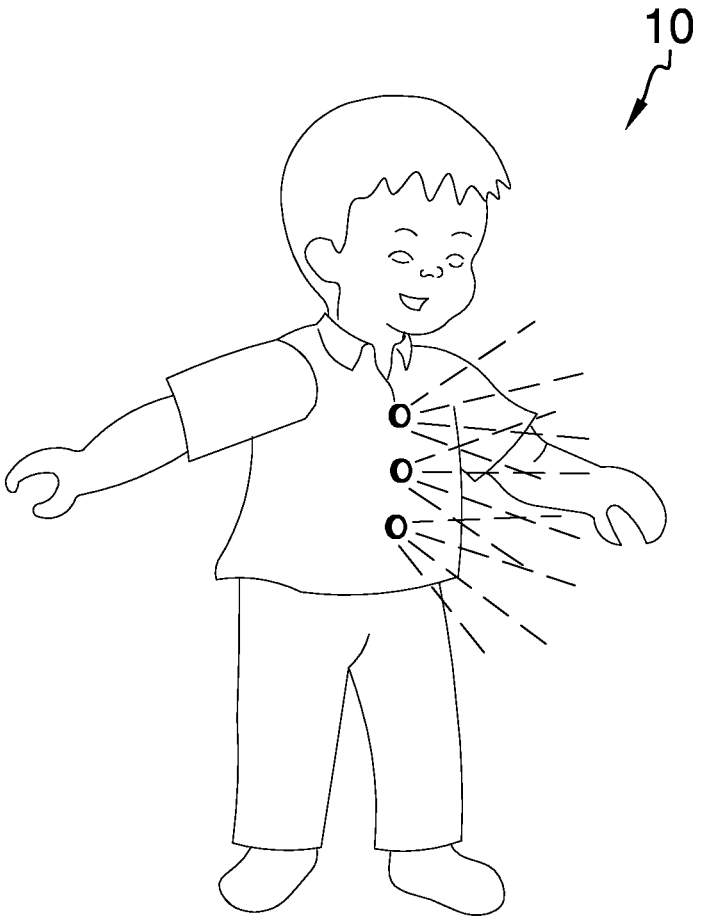
FIG. 5 is an in use view.

With reference now to the drawings, and in particular FIGS. 1 through 5 thereof, an example of the instant illumination device for a button employing the principles and concepts of the present illumination device for a button and generally designated by the reference number 10 will be described.

Referring to FIGS. 1 through 5 the present illumination device for a button 10 is illustrated. The illumination device for a button 10 includes a substantially cylindrical housing unit 20 having a top surface 22, a bottom surface 24, an outer edge 26, and substantially cylindrical hollow top portion 28 having a threaded exterior surface 30. A substantially cylindrical base unit 32 has an interior surface 34 threadably engageable with the exterior surface 30 of the top portion 28 of the housing unit 20. A diameter of the base unit 32 substantially conforms to the diameter of the top surface 22 of the housing unit 20. A battery 36 is removably disposed within the top portion 28 of the housing unit 20. A depressible push cap 38 is mounted atop the housing unit 20. The push cap 38 encloses a push button actuator 40 and a light bulb 42. The push button actuator 40, the light bulb 42, and the battery 36 are in operational communication with each other.

The illumination device for a button 10 further includes a substantially U-shaped semi-flexible clamp 44 having a right end 46, a left end 48, and a pair of leg attachments 50. Each of the pair of leg attachments 50 has a lower edge 52 and an upper edge 54. The lower edge 52 of a first of the pair of leg attachments 56 is attached at a ninety degree angle to the clamp 44 adjacent to the right end 46, and the lower edge 52 of a second of the pair of leg attachments 58 is attached at a ninety degree angle to the clamp 44 adjacent to the left end 48. The upper edge 54 of each of the first of the pair of leg attachments 56 and the second of the pair of leg attachments 58 is attached to the bottom surface 24 of the housing unit 20 proximal the outer edge 26. The clamp 44 is disposed underneath the housing unit 20 within an entirety of a circumference of the housing unit 20. The clamp 44 is removably and slidably engageable with a button 60. The housing unit 20 is disposed atop the button 60 when the clamp 44 is engaged with the button 60.

What is claimed is:

1. An illumination device for a button comprising:

a substantially cylindrical housing unit having a top surface, a bottom surface, an outer edge, and a substantially cylindrical hollow top portion having a threaded exterior surface, wherein a diameter of the top portion is less than a diameter of the housing unit top surface;

a substantially cylindrical base unit having an interior surface threadably engageable with the top portion exterior surface of the housing unit, wherein a diameter of the base unit substantially conforms to the diameter of the housing unit top surface;

a battery removably disposed within the top portion of the housing unit;

a depressible push cap mounted atop the housing unit, the push cap enclosing a push button actuator and a light bulb;

wherein the push button actuator, the light bulb, and the battery are in operational communication with each other;

wherein the push cap is configured to activate the light when the push cap is depressed by a user; and a substantially U-shaped semi-flexible clamp having a right end, a left end, and a pair of leg attachments, each of the pair of leg attachments having a lower edge and an upper edge; wherein the lower edge of a first of the pair of leg attachments is attached at a ninety degree angle to the clamp adjacent to the right end, and the lower edge of a second of the pair of leg attachments is attached at a ninety degree angle to the clamp adjacent to the left end, wherein the upper edge of each of the first of the pair of leg attachments and the second of the pair of leg attachments is attached to the bottom surface of the housing unit proximal the outer edge;

wherein the clamp is disposed underneath the housing unit within an entirety of a circumference of the housing unit;

wherein the clamp is removably and slidably engageable with a button;

wherein the housing unit is disposed atop the button when the clamp is engaged with the button.

2. The illumination device for a button of claim 1 wherein the housing unit and the base unit are metal.

3. The illumination device for a button of claim 2 wherein the push cap is plastic.

* * * * *